US011702795B2

(12) United States Patent
Orgård et al.

(10) Patent No.: US 11,702,795 B2
(45) Date of Patent: Jul. 18, 2023

(54) APPARATUS FOR WASHING AND DEWATERING PULP, A SYSTEM FOR CONTROLLING SUCH AN APPARATUS, AND A METHOD FOR PROCESSING PULP IN SUCH AN APPARATUS

(71) Applicant: VALMET AB, Sundsvall (SE)

(72) Inventors: Jonas Orgård, Stöde (SE); Hans Lövgren, Sundsvall (SE); Stefan Norberg, Söråker (SE); Hans-Olof Eriksson, Gävle (SE); Peter Öhrström, Njurunda (SE)

(73) Assignee: VALMET AB, Sundsvall (SE)

( * ) Notice: Subject to any disclaimer, the term of this patent is extended or adjusted under 35 U.S.C. 154(b) by 919 days.

(21) Appl. No.: 16/332,994

(22) PCT Filed: Sep. 11, 2017

(86) PCT No.: PCT/SE2017/050891
§ 371 (c)(1),
(2) Date: Mar. 13, 2019

(87) PCT Pub. No.: WO2018/052361
PCT Pub. Date: Mar. 22, 2018

(65) Prior Publication Data

US 2019/0264387 A1 Aug. 29, 2019

(30) Foreign Application Priority Data

Sep. 15, 2016 (SE) ..... 1651232-9

(51) Int. Cl.
*D21C 9/06* (2006.01)
*D21C 9/18* (2006.01)

(52) U.S. Cl.
CPC ..... *D21C 9/06* (2013.01); *D21C 9/18* (2013.01)

(58) Field of Classification Search
CPC ..... D21C 9/06
See application file for complete search history.

(56) References Cited

U.S. PATENT DOCUMENTS 3,730,079 A 5/1973 Stirk et al.
8,808,499 B2 8/2014 Bylander et al.
(Continued)

FOREIGN PATENT DOCUMENTS

CN 2320650 Y 5/1999
CN 101896666 A 11/2010
(Continued)

OTHER PUBLICATIONS

Lahtinen Juri, Washing Adavanced Process Control Solutions, May 16, 2011, Washing Seminar, Stockholm. (Year: 2011).*
(Continued)

*Primary Examiner* — Anthony Calandra
(74) *Attorney, Agent, or Firm* — Foley & Lardner LLP

(57) ABSTRACT

A method for processing pulp in an apparatus for washing and dewatering pulp, and a system for controlling this apparatus, the apparatus comprising two rotatable press rolls (102, 104) having a permeable outer surface (106, 108), and a vat (114, 116, 118), the press rolls (102, 104) defining a press nip (112) between them. The processing is determined by a set of variable operating parameters, which are adjusted and/or maintained during operation in response to deviations of measured values of control parameters in relation to their respective predetermined threshold values. The variable operating parameters include rotation speed of the press rolls. The control parameters include vat pressure and/or linear load.

29 Claims, 7 Drawing Sheets

(56) References Cited

U.S. PATENT DOCUMENTS

| | | | | |
|---|---|---|---|---|
| 9,200,407 | B2 | 12/2015 | Bylander et al. | |
| 2010/0155007 | A1* | 6/2010 | Andersson | D21C 9/06 162/232 |
| 2014/0203059 | A1* | 7/2014 | Wegele | D21G 1/004 226/176 |
| 2015/0361617 | A1* | 12/2015 | Lööf et al. | D21C 9/18 162/348 |

FOREIGN PATENT DOCUMENTS

| | | | |
|---|---|---|---|
| EP | 1 035 250 | A2 | 9/2000 |
| GB | 1 388 079 | A | 3/1975 |
| JP | 03-259846 | A | 11/1991 |
| JP | 2003-301396 | A | 10/2003 |
| SE | 532099 | C2 | 10/2009 |
| SU | 514925 | A | 5/1976 |
| WO | WO 87/06282 | A1 | 10/1987 |
| WO | WO-98/54401 | A1 | 12/1998 |
| WO | WO 2009/075645 | A1 | 6/2009 |
| WO | WO 2010/036192 | A1 | 4/2010 |
| WO | WO 2012/128711 | A1 | 9/2012 |
| WO | WO 2014/09693 | A1 | 7/2014 |
| WO | WO-2014/109693 | A1 | 7/2014 |

OTHER PUBLICATIONS

Papermaking Science and Technology, Book 6A, Chemical Pulping, printed 2000, published by Fapet Oy, 5 pages.

Chinese Office Action, Application No. 201780055400.4, dated Mar. 3, 2021, 13 pages.

Extended European Search Report, Application No. 17851180.4, dared Jan. 29, 2020, 7 pages.

* cited by examiner

APPARATUS FOR WASHING AND DEWATERING PULP, A SYSTEM FOR CONTROLLING SUCH AN APPARATUS, AND A METHOD FOR PROCESSING PULP IN SUCH AN APPARATUS

TECHNICAL FIELD

The present invention relates to methods and systems for processing pulp, especially cellulose-containing pulp, in an apparatus for washing and dewatering pulp, especially cellulose-containing pulp, comprising two rotatable press rolls having a permeable outer surface, and a vat in which the press rolls are installed, the press rolls defining a press nip between them, in which press nip the pulp is pressed, and the apparatus is arranged to feed the pulp in the direction of rotation of the press rolls through the press nip, at least one of the press rolls being movable in relation to the other press roll by means the press nip can be varied. The processing of the pulp in the apparatus is determined by a set of variable operating parameters which are variable during operation. In embodiments of the present invention the press nip and the rotation speed of the press rolls are operating parameters and in other embodiments the rotation speed is operating parameter if the invention is used in a system with a fixed press nip. Further, the present invention relates to a system for controlling an apparatus of the above-mentioned type, and to an apparatus of the above-mentioned type comprising a system for controlling the apparatus.

BACKGROUND OF THE INVENTION

When producing cellulose-based products, a roll press is frequently used for washing and dewatering the cellulose-based pulp. The pulp is passed between two co-operating press rolls installed in the roll press, the press rolls having a perforated outer surface, a so called mantle surface, whereby the outer surface is permeable to liquid pressed out of the pulp, and the pulp is pressed in the roll nip, or the press nip, between the press rolls, whereby liquid is pressed out of the pulp. The roll press also includes one or more washing zones and/or dewatering zones prior to the press nip. One example of such a roll press is disclosed in EP 1 035 250, where the central axes of the press rolls are lying in substantially the same horizontal plane, and the pulp is fed in the direction of rotation of the press rolls through the press nip and the pulp is passing the press nip between the press rolls from below upwards.

Mainly, even if there exists other types of control systems such as systems based on output from apparatus, control systems for press roll apparatuses for washing of pulp is based on the torque and the rotation speed of the press rolls is adjusted to maintain a desired value of the torque. For example, if the output of the apparatus increases, the rotation speed of the rolls is increased in order to maintain the desired value of the torque.

A number of attempts to improve output and washing efficiency has been made. For example, U.S. Pat. No. 3,730,079 discloses a press comprising two press rolls rotatable about parallel axes, wherein one of the press rolls is laterally movable relative to the other to vary the cross-section of the therebetween press nip. Pressing force is applied to the laterally movable press roll by a plurality of separate link systems actuated by individual fluid pressure operated actuators. Pneumatically expansible tubes or springs are provided to urge the movable press roll away from the other. The object of this press is to maintain the axes of the press rolls parallel while permitting relative lateral movement of the press rolls.

In SE 532099 a system and method is disclosed where the distance between the press rolls is a variable operating parameter, at least one desired value for a specific control parameter is set, the control parameters include the distance between the press rolls, the specific control parameter is measured the specific control parameter; and wherein the distance between the press rolls is adjusted during operation to keep the difference between the set desired value and the value of the measured specific control parameter below a certain level.

However, there is still a need for improved and more flexible methods and systems for processing of pulp in an apparatus for washing and dewatering pulp comprising two rotatable press rolls, which more accurately provides pulp with the quality which is desired, and which increases the capacity of the apparatus.

SUMMARY OF THE INVENTION

The present invention is based on the insight that high degree of flexibility, improved washing efficiency, capacity of the washing apparatus and production stability can be achieved by providing control methods and systems including a first control loop based on rotation speed of the press rolls as variable control parameter, where the adjustment of the rotation speed is controlled or regulated on basis of a first set of control rules including predetermined threshold values for the control parameters linear load and/or vat pressure and in preferred embodiments the torque of the press rolls.

Furthermore, the present invention is based on the insight that high degree of flexibility, improved washing efficiency, capacity of the washing apparatus and production stability can be achieved by providing control methods and systems including a combination of two simultaneously operating control loops, where a first loop is adjustment of rotation speed of press rolls is based on vat pressure and/or linear load, and a second control loop including adjustment of distance between the press rolls based on linear load and vat pressure. The first control loop is based on the first set of control rules and the second control loop is based on a second set of control rules. In preferred embodiments the first control loop is based on the vat pressure, linear load and torque.

Generally, the first control loop where the rotation speed is controlled based on the control parameters vat pressure and/or linear load (and in preferred embodiments the torque) aims at successively bringing the respective control parameter to their respective predetermined (e.g. set by an operator) threshold value or as close as possible to that value at the same time as the rotation speed successively is reduced. The second control loop where the distance between the press rolls is controlled based on the control parameters vat pressure and linear load aims at successively bringing the respective control parameter to their respective predetermined (e.g. set by an operator) threshold value or threshold value or as close as possible to that value.

In embodiments of the present invention, satisfactory results with regard to washing efficiency, capacity of the washing apparatus and production stability can be achieved by providing control methods and systems including a combination of two simultaneously operating control loops, where a first loop is adjustment of rotation speed of press rolls based on any one or a combination of vat pressure, and/or linear load (in preferred embodiments vat pressure, linear load and torque), and a second control loop including adjustment of distance between the press rolls based on linear load and vat pressure.

In embodiments of the present invention, satisfactory results with regard to washing efficiency, capacity of the washing apparatus and production stability can be achieved by providing a control method and system including the first loop where adjustment of rotation speed of press rolls based on vat pressure, torque and linear load.

According to an object of the present invention, there is provided methods and systems for improving washing efficiency, capacity of the washing apparatus and production stability.

These and other objects are achieved in accordance with the appended claims.

In the context of the present invention, the term "during operation" refers to during ongoing operation of the apparatus, i.e. the operating parameters are adjustable while the apparatus is continuously running, idle running or while pressing and washing pulp, without being forced to shut down the apparatus. The axes of rotation of the press rolls can be in substantially the same horizontal plane, and the movable press roll is then laterally movable in relation to the other, or the axes of rotation of the press rolls can be positioned in other ways. The axes of rotation of the press rolls can, for example, be in substantially the same vertical plane, and the movable press roll is then movable in a substantially vertical direction, upwards or downwards.

According to an aspect of the present invention, there is provided a method in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in the direction of rotation of the press rolls through the press nip, and the processing of the pulp in the apparatus is determined by at least one variable operating parameter which is variable during operation. The method includes the steps of:

including the rotation speed of the press roll as variable operating parameter;

including vat pressure and/or linear load as control parameters, each being associated with a predetermined threshold value;

measuring the control parameters;

comparing measured control parameters and respective predetermined threshold value; and if a measured control parameter and a respective threshold deviates (often, during operation, a deviation means that the measured value is lower than the threshold value but under certain conditions the deviation may be that the measured value exceeds the threshold value) from each other, adjusting and/or maintaining the rotation speed during operation according to a first set of control process rules, for example, if at least one of the measured control parameters corresponds to the respective threshold value and none of the measured control parameters exceeds their respective threshold value, the rotation speed is maintained at the present speed. According to embodiments, wherein at least one of the press rolls is movable in relation to the other press roll to vary the press nip, the method further comprises:

including the distance between the press rolls as variable operating parameter; and if a measured value of a linear load and/or vat pressure and a respective threshold value deviates from each other, adjusting the distance between the press rolls during operation according to a second set of control process rules, wherein said second set of control process rules are operated in synchronism with said first set of control process rules. The second set of control process rules may, for example, include increasing the distance between the press rolls if the linear load is measured to correspond to the respective threshold value and the vat pressure is measured to deviate from the threshold value.

In embodiments, it is also conceivable to include, for example, the pressure of the pulp distribution device or the throttle gap width as operating parameters. Throttle gap width refers to the variable opening gap of a throttle. For example, the throttle is arranged close to or in the outlet of the pulp distribution device. Such a throttle is described in the international patent application WO 2014109693.

In preferred embodiments, the torque is included as control parameter and a threshold value is associated with the torque.

Further, it conceivable to include outlet consistency, the flow rate of the pulp into the pulp distribution device and the ratio between the rotation speed of the press roll and the flow rate of the pulp into the pulp distribution device as control parameters.

In preferred embodiments of the present invention, the adjustments of the at least one operating parameter aims at bringing the respective control parameter or at least one or some of the control parameters as close as possible to the respective threshold value, which may be set by the operator and may be set to a maximum desired value, for example, with regard to wear of, performance of, or process efficiency of the apparatus for washing and dewatering pulp. If the threshold value is a maximum value, the adjustments of operating parameters aims at bringing the control parameters close to their respective maximum value (i.e. the set threshold value)

According to yet another aspect of the present invention, there is provided a method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in the direction of rotation of the press rolls through the press nip, and the processing of the pulp in the apparatus is determined by a set of variable operating parameters which are variable during operation.

According to embodiments, the first and second set of control process rules may include (however, the following rules are one exemplary and is a non-exhaustive list of rules):

the first set may include, if a measured value of at least one control parameter and a respective threshold value corresponds to each other, maintaining the rotation speed of the press roll at present level.

the first and second set may include, if a measured value of a control parameter and a respective threshold value corresponds to each other for all control parameters, maintaining the distance between the press rolls and the rotation speed of the press roll at present level.

the first and second set may include, if a measured value of vat pressure and linear load and a respective threshold value corresponds to each other, maintaining the distance between the press rolls and the rotation speed of the press roll at a present level. However, if the torque (or pressure in the pulp distribution device) at the same time exceeds the threshold, the rotation speed should be increased.

the first set may include, if a measured value is higher than the threshold value, increasing the rotation speed of the press roll.

the first set may include, if a measured value of a control parameter and a respective threshold value deviates from each other and the measured values all are below the respective threshold values, decreasing the rotation speed of the press roll.

the second set may include, if a measured value of vat pressure or linear load and a respective threshold value deviates from each other, adjusting the distance between the press rolls.

the second set may include, if a measured value of linear load and the respective threshold value deviates from each other and the threshold value and the measured value of the vat pressure corresponds to each other, decreasing the distance between the press rolls.

the second set may include, If a measured value of the linear load is lower than the threshold value, and the threshold value and the measured value of the vat pressure corresponds to each other, decreasing the distance between the press rolls.

the second set may include, if a measured value of vat pressure and the respective threshold value deviates from each other and the linear load and the threshold value corresponds to each other, increasing the distance between the press rolls.

the second set may include, if a measured value of vat pressure is lower than threshold value and the linear load corresponds to the threshold value, increasing the distance between the press rolls.

The examples above, is a non-exhaustive list of process rules. For example, further rules include that the second set include, if a measured value of vat pressure or linear load and a respective threshold value deviates from each other, adjusting the distance between the press rolls such that the sum of the deviation between the vat pressure and the respective threshold value and the linear load and the respective threshold value is minimized.

According to a further aspect of the present invention, there is provided a system for controlling an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in the direction of rotation of the press rolls through the press nip, and the processing of the pulp in the apparatus is determined by at least one variable operating parameters which are variable during operation. The rotation speed of the press roll is included as variable operating parameter. The system further comprises measuring means for measuring a value of control parameters, wherein vat pressure and/or linear load are included as control parameters, an analysing device arranged to compare a measured value of a control parameter and a respective threshold value in order to identify deviations between them, and adjustments means for adjusting and/or maintaining the rotation speed during operation if deviations is identified during operation according to a first set of control process rules.

It is also possible to include, for example, the pressure of the pulp distribution device or the throttle gap width as operating parameters.

The system comprises setting means for setting at least one threshold value for the respective control parameter, wherein combinations vat pressure and/or linear load, in embodiments, also torque are included as control parameters depending on the control loop.

Further, it is also possible to include outlet consistency, the flow rate of the pulp into the pulp distribution device and the ratio between the rotation speed of the press roll and the flow rate of the pulp into the pulp distribution device as control parameters.

In embodiments of the present invention, there is provided a system comprising at least one movable press roll in relation to the other press roll to vary the press nip, wherein the distance between the press rolls is included as variable operating parameter, wherein vat pressure and linear load are included as control parameters, and wherein said adjustments means is arranged for adjusting the distance between the press rolls during operation according to a second set of control process rules. The second set of control process rules are operated in synchronism with the first set of control process rules, if a linear load and/or vat pressure and a respective threshold value deviates from each other.

In embodiments of the present invention, the system further comprises setting means for setting at least one threshold value for the respective control parameter.

In embodiments of the present invention, a controller is arranged to, according to the first set of control process rules, instruct the adjustments means to, if a measured value of a control parameter and a respective threshold value corresponds to each other, maintain the rotation speed of the press roll at present level.

In embodiments of the present invention, the adjustment means includes rotation speed adjustment device for adjusting the rotation speed of the press rolls.

In embodiments of the present invention, the adjustment means includes at least one hydraulic driving device for urging the movable press roll away from the other or towards each other.

In embodiments of the present invention, the controller is arranged to, according to the first set of control process rules, instruct the adjustments means to, if a measured value of a control parameter and a respective threshold value corresponds to each other for all control parameters, maintain the distance between the press rolls and the rotation speed of the press roll at present level.

In embodiments of the present invention, the controller is arranged to, according to the second set of control process rules, instruct the adjustments means to, if a measured value of vat pressure and linear load and a respective threshold value corresponds to each other, to maintain the distance between the press rolls and the rotation speed of the press roll at present level.

In embodiments of the present invention, the controller is arranged to, according to the first set of control process rules, instruct the adjustments means to, if a measured value is higher than the threshold value, instruct the adjustment means to increase the rotation speed of the press roll.

In embodiments of the present invention, the controller is arranged to, according to the first set of control process rules, instruct the adjustments means to, if a measured value of a control parameter and a respective threshold value deviates from each other and the measured values are below the respective threshold values, decrease the rotation speed of the press roll.

In embodiments of the present invention, the controller is arranged to, according to the second control process rules, instruct the adjustments means to, if a measured value of vat pressure or linear load and a respective threshold value deviates from each other, adjust the distance between the press rolls.

In embodiments of the present invention, the controller is arranged to, according to the second set of control process rules, instruct the adjustments means to, if a measured value of linear load and the respective threshold value deviates from each other and the threshold value and the measured value of the vat pressure corresponds to each other, decrease the distance between the press rolls.

In embodiments of the present invention, the controller is arranged to, according to the second set of control process rules, instruct the adjustments means to, if a measured value of linear load is below the threshold value and the measured value of the vat pressure and the respective threshold value corresponds to each other, decrease the distance between the press rolls.

In embodiments of the present invention, the controller is arranged to, according to the second set of control process rules, instruct the adjustments means to, if a measured value of vat pressure and the respective threshold value deviates from each other and the linear load corresponds to each other, increase the distance between the press rolls to reduce the difference to be below the predetermined level.

In embodiments of the present invention, the controller is arranged to, according to said second set of control process rules, instruct the adjustments means to, if a measured value of vat pressure is below the threshold value and the linear load and the respective threshold value corresponds to each other, increase the distance between the press rolls to reduce the difference to be below the predetermined level.

According to a further aspect of the present invention, there is provided an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in the direction of rotation of the press rolls through the press nip, and the processing of the pulp in the apparatus is determined by a set of variable operating parameters which are variable during operation, and the apparatus comprises a system according to aspects of the present invention.

In addition there is provided a computer program product comprising instructions which, when a program is executed by a computer causes the computer to carry out methods according to the present invention.

According to a further aspect of the present invention, there is provided computer-implemented methods according to the present invention.

By the present invention, the performance and the flexibility of the apparatus can be improved significantly. For example, the present invention entails that the apparatus can be operated closer to the maximum values or limits of the control parameters, e.g. linear load and vat pressure, which provides a higher output consistency and an improved washing efficiency. Further examples of advantages include that the present invention enables a limitation of the linear load, in order to reduce wear, and/or in order to achieve a desired level of linear load in terms of process efficiency. The present invention also provides possibilities to reduce vat pressure in order to decrease fibre losses.

Another advantage of the present invention, is that it significantly reduces the need for manual surveillance since the control loops operates automatically. This also eliminates differences between different operators and reduces the risk for unwanted production stops since the control system handles disturbances automatically.

Yet another advantage of the present invention is that the present invention can be implemented in systems using the traditional approach for control, i.e. a control of the rotation speed only based on threshold value for the torque.

In total, the present invention achieves an improved washing efficiency, capacity of the washing apparatus and production stability.

The threshold values for the control parameters can be set by the operator during the operation of the apparatus, and also changed during operation. The adjustment of the variable operating parameters can be performed according to different kinds of algorithms or techniques, depending on the number of variable operating parameters being adjusted. For example, several operating parameters can be adjusted simultaneously, or one operating parameter can be adjusted at a time, and thereafter another.

According to an advantageous embodiment of the present invention, at least one maximum value for the control parameters, for example, vat pressure, torque and linear load are set as threshold value, and the variable operating parameters are adjusted during operation to bring them closer to or keep the control parameters at their respective maximum value. This further improves the performance and the flexibility of the apparatus, whereby a desired quality of the pressed pulp can be attained in a more efficient way.

Further advantageous embodiment of the apparatus according to the present invention emerge from the dependent claims and the detailed description of preferred embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
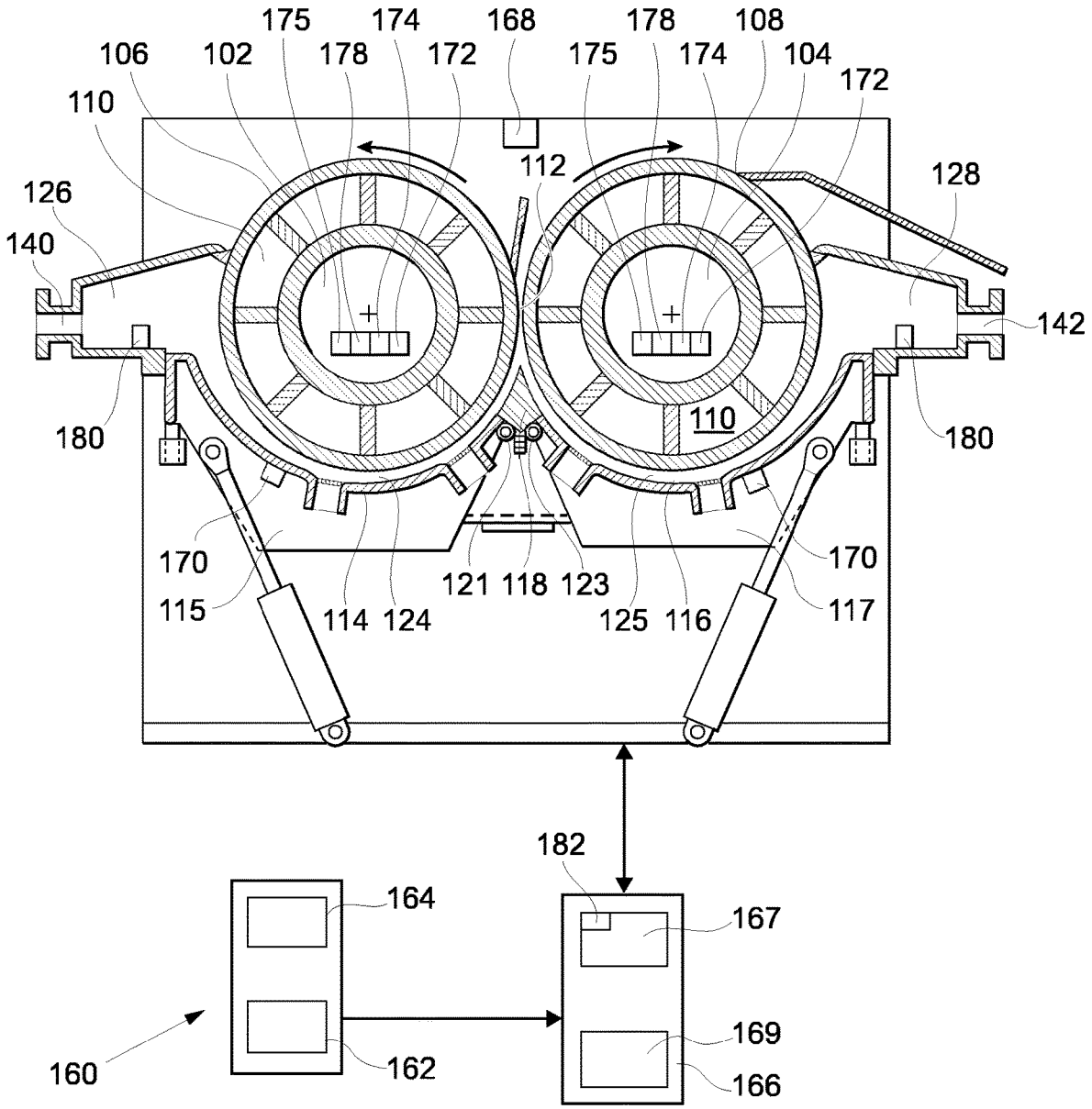
FIG. 1 is a schematic view of an embodiment of the apparatus for washing and dewatering pulp provided with an embodiment of the system for controlling it according to present invention.

FIG. 1 schematically shows an embodiment of the apparatus for washing and dewatering cellulose-containing pulp according to the present invention provided with an embodiment of the system according to the present invention schematically illustrated with blocks. Also in WO 2014/109693, an apparatus for washing and/or dewatering of pulp in which the present invention can be used is described, which hereby is incorporated with reference.

The apparatus comprises a first rotatable press roll 102 and a second rotatable press roll 104, each press roll 102, 104 having a permeable outer surface 106, 108 which is perforated, i.e. provided with apertures, whereby the outer surface 106, 108 is permeable to filtrate pressed out of the pulp. The shape of the apertures is normally circular, but any shape is possible. The press rolls 102, 104 comprise a number of filtrate channels 110 radially inwards of the outer surface 106, 108 to lead evacuated filtrate away. The two press rolls 102, 104 defines a press/roll nip 112 between them, in which press nip 112 the pulp is pressed, and are arranged to rotate in opposite directions, the left press roll 102 being arranged to rotate in counter clockwise direction and the right press roll 104 being arranged to rotate in clockwise direction. The apparatus is arranged to feed the pulp in the direction of rotation of the press rolls 102, 104 through the press nip 112. The axes of rotation of the press rolls 102, 104 being in substantially the same horizontal plane, and the apparatus is arranged to feed the pulp through the press nip 112 in a substantially vertical direction from below upwards. One of the press roll 102, 104, herein the first press roll 102, is laterally movable in relation to the other press roll 104 to vary the press nip 112 under the operation of the apparatus. In other embodiments of the press, both press rolls 102, 104 are laterally movable to vary the press nip 112 under the operation of the apparatus. The processing of the pulp in the apparatus is determined by a set of variable operating parameters which are variable during operation.

The apparatus comprises a casing which includes a vat 114, 116, 118 in which the press rolls 102, 104 are installed, the vat 114, 116, 118 partly enclosing the outer surface 106, 108 of each press roll 102, 104, whereby a gap 124, 125 for each press roll 102, 104 is defined, limited by the vat 114, 116, 118 and the outer surface 106, 108 of the respective press roll 102, 104. The vat 114, 116, 118 can be pressurized and comprises a first side vat segment 114 which partly encloses the outer surface 106 of the first press roll 102, and a second side vat segment 116 which partly encloses the outer surface 108 of the second press roll 104.

Said casing comprises a first casing member 115 which extends between the ends of the first press roll 102 and to which the first side vat segment 114 is mounted, and a second casing member 117 which extends between the ends of the second press roll 104 and to which the second side vat segment 116 is mounted. The first casing members 115 is pivotable about a first axle 121 and the second casing members 117 is pivotable about a second axle 123, whereby the casing members 115, 117, together with their side vat segments 114, 116, are movable between a closed position and an opened position for providing access to the press rolls 102, 104. Further, the vat 114, 116, 118 comprises a central vat segment 118 partly enclosing the outer surface 106, 108 of the press rolls 102, 104 between the press nip 112 and the side vat segments 114, 116.

The apparatus comprises a first pulp distribution device 126 for distributing pulp on the first press roll 102 and a second pulp distribution device 128 for distributing pulp on the second press roll 104. The pulp distribution devices 126, 128 are arranged to distribute pulp to the gap 124 along the whole length of each press roll 102, 104. The pulp distributed on the outer surface 106, 108 of the press roll 102, 104 forms a mat on the press rolls 102, 104. Herein, the pulp distribution device 126, 128 is in the form of a pulp distribution screw. However, other kinds of pulp distribution devices are possible. The pulp distribution device 126, 128 can also comprise several separate pulp distribution means distributed one after the other along the longitudinal extension of the press roll 102, 104. Each pulp distribution device 126, 128 is connectable to a pulp supplying system via connection means 140, 142, and the supplying system supplies pulp to each pulp distribution device 126, 128.

The apparatus also includes a pulp transport screw (not shown), which for example can be in the form of a pulp disintegrating screw or a shredder screw, towards which the pulp which has been pressed in the press nip 112 is conveyed. The pulp transport screw extends in parallel to the longitudinal axes of the press rolls 102, 104, and is arranged to disintegrate the pulp and transport the pulp axially away from the press for further processing.

The system of the present invention is adapted to control the apparatus by controlling at least one variable operating parameter which is variable during operation and determine the processing of the pulp in the apparatus. According to preferred embodiments of the present invention, the operating parameters may include:

- the rotation speed of the press rolls 102, 104, which is used in the first control loop;

In certain embodiments, the control of the apparatus is based on the first control loop. Further, the operating parameters may also include:

- the distance between the press rolls 102, 104, which corresponds to the cross-section of the press-nip 112, which is used in the second control loop;

In embodiments where the first and second control loop is run in synchronism, both operating parameters are hence used. In addition, further variable operating parameters can also be included such as:

- pressure in the pulp distribution device 126, 128.
- Throttle gap width, which refers to the opening gap of a throttle arranged close to or in the outlet of the pulp distribution device. This is, for example, described in the international patent application WO 2014109693.

The system may comprise an operator unit 160 for setting at least one threshold value for a specific control parameter, the specific control parameter being included in a group of control parameters. The unit 160 is only schematically illustrated in FIG. 1 and may include a input means 162 via which the control parameters is set, and display means 164 for displaying the set control parameter. In embodiments, the setting means may be an operator unit, a stationary computer, a laptop, a mobile unit or any other device communicating with the system and enabling an operator to setting and adjusting threshold values.

According to preferred embodiments of the present invention, the following control parameters are included in said group:

- the torque of the press rolls 102, 104*r;*
- the linear load which acts on the pulp in the press nip 112 and is affected by the torque of the press rolls 102, 104; and/or
- the vat pressure, i.e. the pressure within the vat, (and/or pressure at inlet of vat).

Further control parameters can also be included in the group, such as:

- outlet consistency;
- the flow rate of the pulp into the pulp distribution device 126, 128; and
- the ratio between the rotation speed of the press roll 102, 104 and the flow rate of the pulp into the pulp distribution device 126, 128.

The system includes measuring means for measuring the specific control parameter, and the measuring means include means 168 for measuring the outlet pulp consistency, means 170 for measuring the vat pressure, means 172 for measuring the distance between the press rolls 102, 104, means 174 for measuring the torque of the press rolls 102, 104, means 175 for measuring the linear load, means 178 for measuring the rotation speed of the press roll 102, 104, means 180 for measuring the flow rate of the pulp into the pulp distribution device 126, 128, and means for 182 for measuring or calculating the above-mentioned ratio. Above-mentioned means for measuring are in the form of suitable sensors or equipment. The means 170 for measuring the vat pressure can be installed at various places in the vat, for example at lowest region/-s in the vat to measure the vat pressure there. The linear load can for example be measured by providing the means 175 for measuring the linear load in connection to the bearings of the press rolls 102, 104, and determine the linear load from the measured load on the bearings.

The system includes adjustment means for adjusting one or several of the variable operating parameters of the set during operation. The adjustment means include means 214 for adjusting the rotation speed of the press rolls 102, 104 and means for adjusting the distance between the press rolls 102, 104, which means include hydraulic driving devices 202 for urging the laterally movable press roll 104 away from and towards the other press roll 102, and for providing and keeping a specific distance between the press rolls 102, 104 (see FIG. 2). However, other means for adjusting the distance between the press rolls 102, 104 are possible, such as means based on electro-mechanics.

The adjustment means can be adapted to adjust only one variable operating parameter, or be adapted to adjust two or more variable operating parameters. When adjusting two or more variable operating parameters, the adjustment means can be adapted to adjust several operating parameters simultaneously, or adapted to adjust one operating parameter at a time, and thereafter another.

The adjustment means, the measuring means, the setting means and the display means are connected to a controller or control device 166 adapted to control or instruct the adjustment means and adapted to retrieve data from the measuring means and the setting means. The control device 166 comprises a processor 167 and storing means 169 for storing data. The control device 166 includes means 182 for performing calculations or an analysing device, for example, said ratio from the measurement of the means 180 for measuring the flow rate of the pulp from the pulp distribution device 126, 128 and the means 178 for measuring the rotation speed of the press roll 102, 104.

Figure 2:
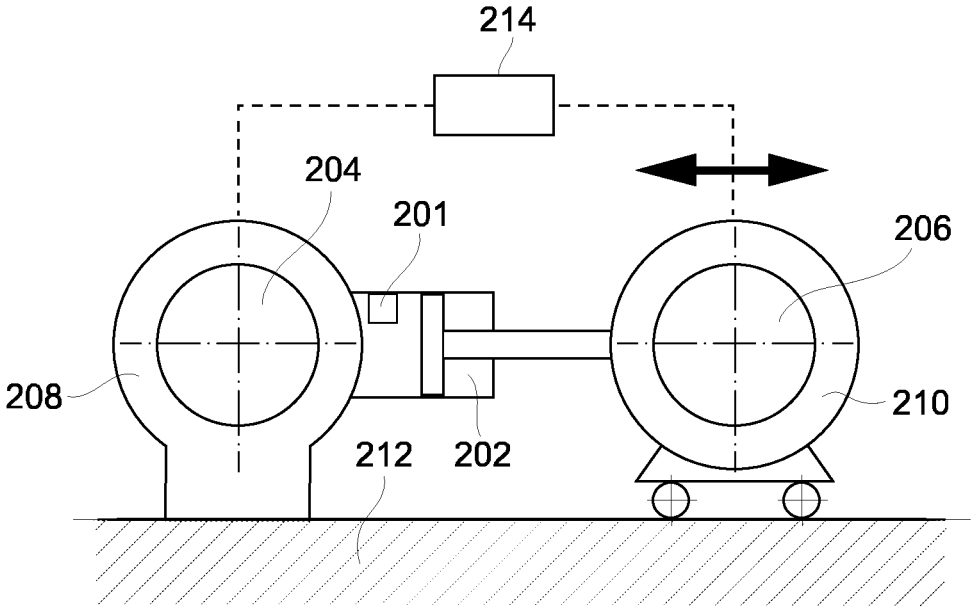
FIG. 2 is a schematic view illustrating a part of the embodiment of the apparatus according to the present invention.

FIG. 2 schematically illustrates an embodiment of the apparatus in which the present invention can be implemented, showing the pivotally mounting of the press rolls at the first end of the apparatus. The shaft 204 of the first press roll 102 and the shaft 206 of the second laterally movable press roll 104 are supported by bearings housed in bearing housings 208, 210. The bearing housing 208 of the first press roll 102 is fixedly attached to the casing 212 of the apparatus, and the bearing housing 210 of the laterally movable press roll 104 is movably attached to the casing 212, whereby the second press roll 104 is movable in relation to casing 212 and laterally movable in relation the other press roll 102. The hydraulic driving device 202 is positioned between the shafts 204, 206 of the press rolls 102, 104 and is connected to the bearing housing 208, 210 of each press roll 102, 104. A corresponding hydraulic driving device is mounted at the second end of the apparatus. The hydraulic driving devices 202 are adapted to urge the laterally movable press roll 104 away from the other press roll 102 and towards the other press roll 102 for providing a specific distance between the press rolls 102, 104 and for keeping this distance. The means 174 for measuring the linear load is in the form of a load cell 201 connected to the hydraulic driving device 202.

Figure 3B:
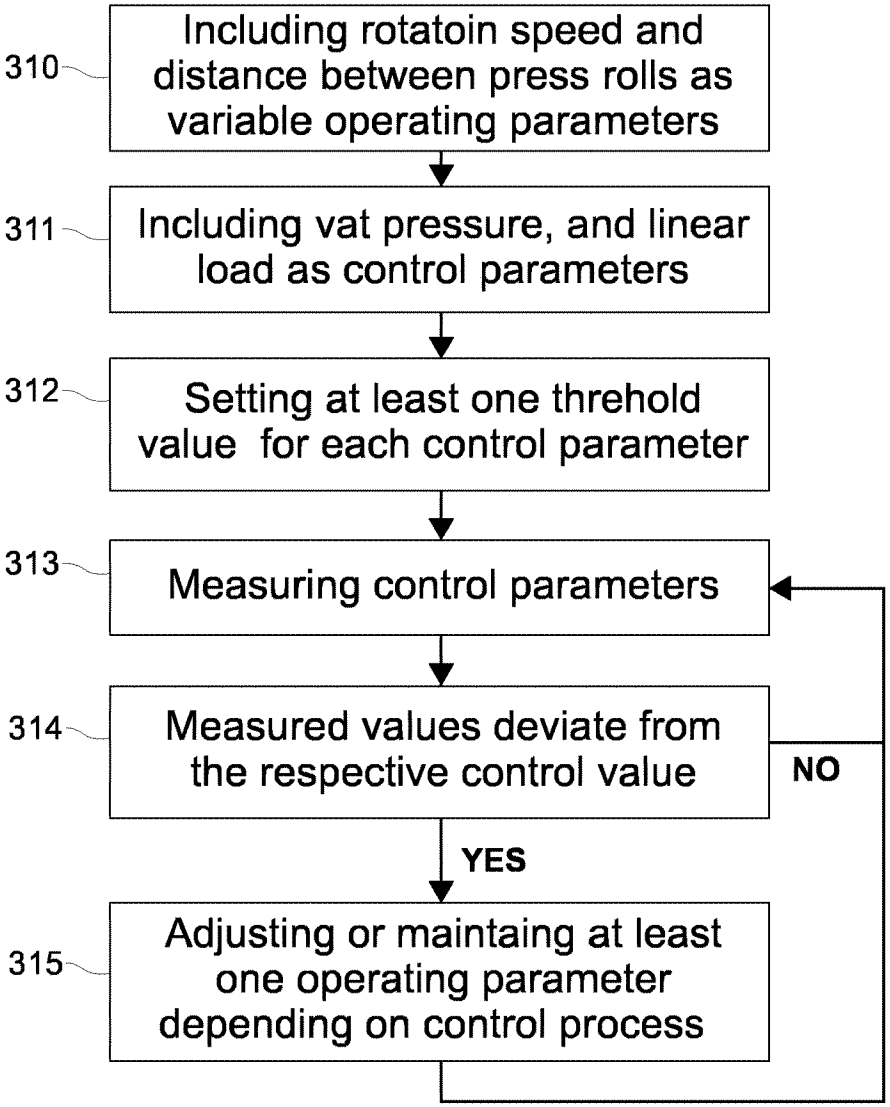
FIG. 3*b* is a schematic flow schedule illustrating further aspects of the method according to the present invention.
Figure 3A:
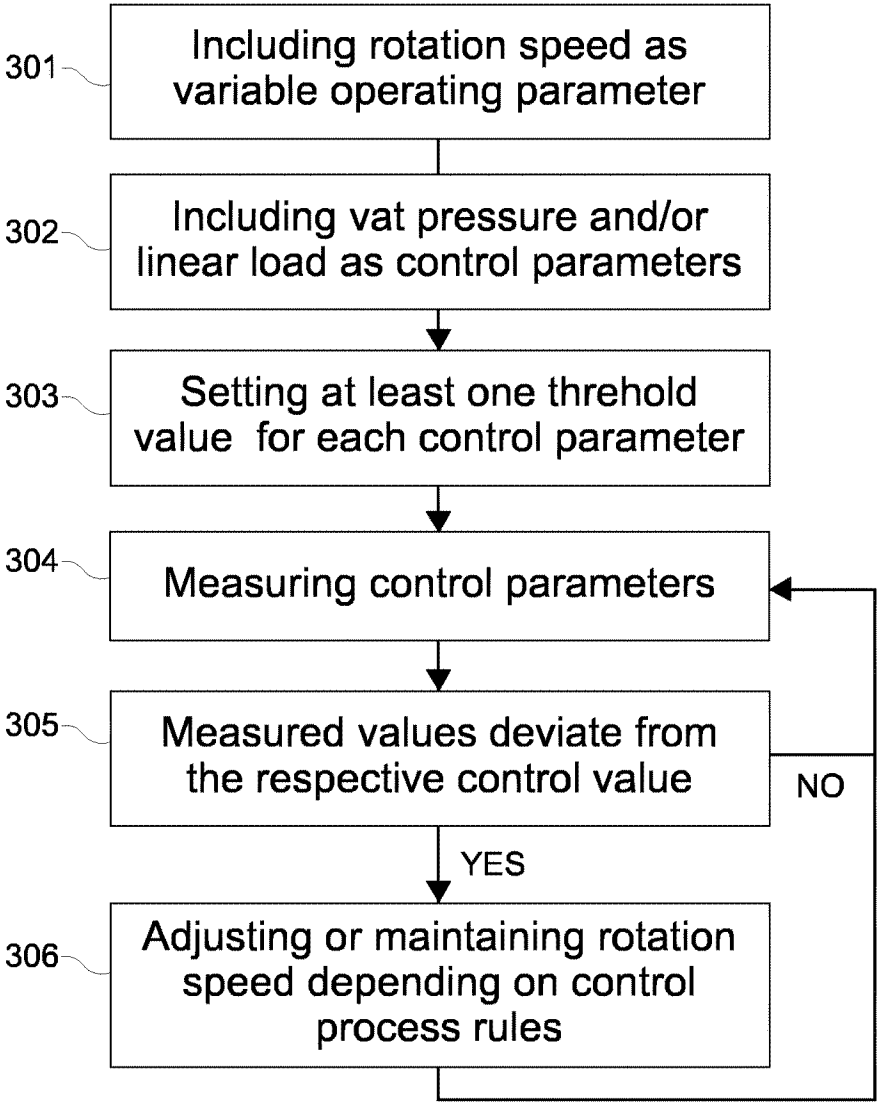
FIG. 3*a* is a schematic flow schedule illustrating aspects of the method according to the present invention.
Figure 3C:
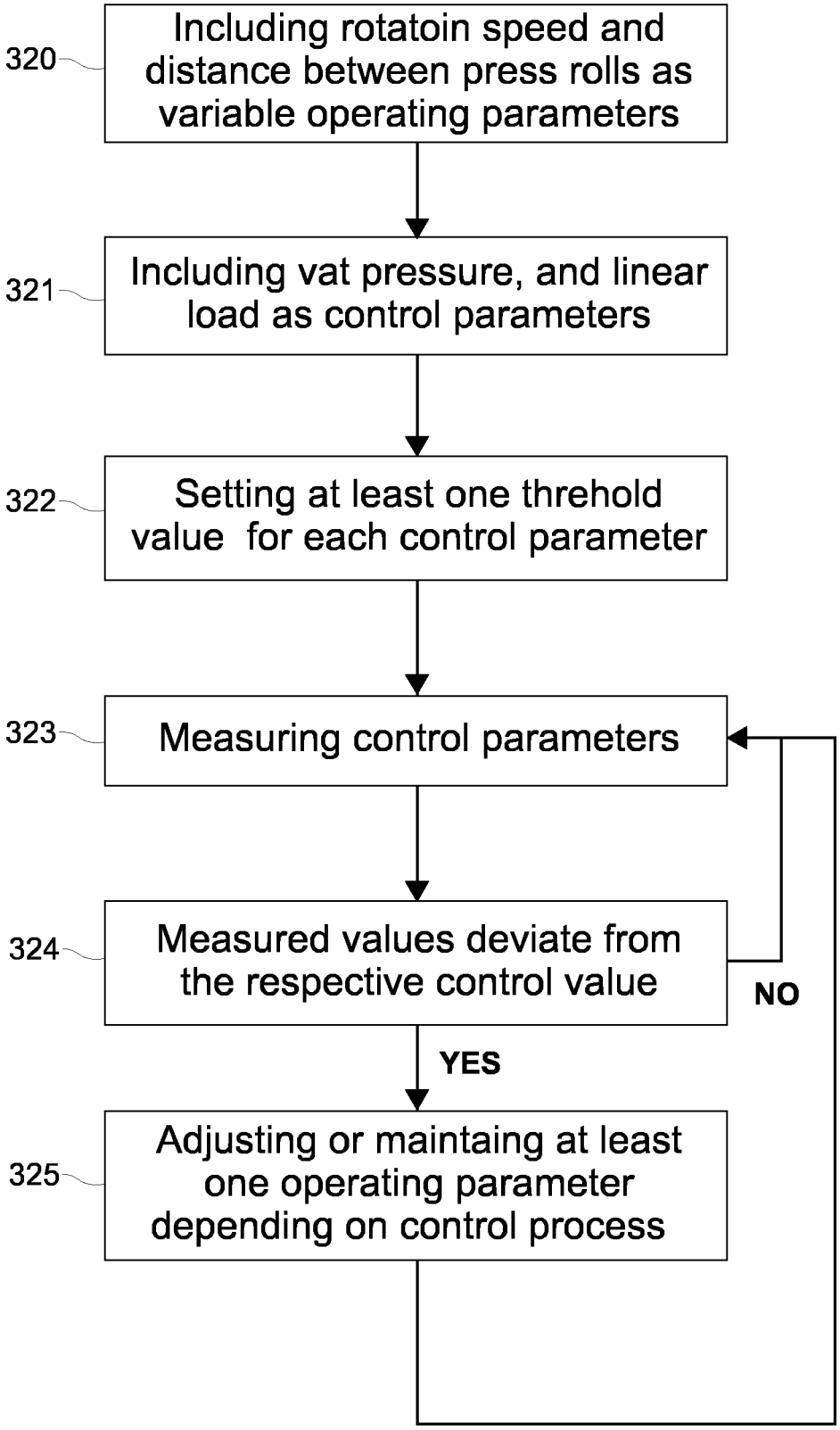
FIG. 3*c* is a schematic flow schedule illustrating further aspects of the method according to the present invention.

FIG. 3*a*-3*c* illustrates aspects of the method according to the present invention by way of schematic flow schedules, which methods are applicable to the apparatus shown in FIG. 1 and FIG. 2, for example, but can also be applied to other apparatus for washing and dewatering cellulose-containing pulp comprising fixed rotatable press rolls (the first control loop shown in FIG. 3*a*), and apparatuses comprising two movable press rolls.

In FIG. 3*a*, the first control loop is generally shown. First, rotation speed of the press rolls is included as variable operating parameter, at 301. The torque and linear load and/or vat pressure is included as control parameters, at 302, and an operator may set a threshold value, e.g. a maximum value for each of them, at 303. During operation of the apparatus, the specific control parameters are measured, at 304. At 305, measured values of control parameters and respective threshold value are compared to identify deviations between them. In practice, the measured value and the respective set threshold value is compared to identify whether the measured value is below or above the respective threshold value (taking into account any tolerance interval surrounding the threshold value). If no, i.e. if there is a deviation between the measured value and respective threshold value differs, one or several variable operating parameters of said set is/are adjusted according to a first set of control rules, at 306, to bring or align the control parameter closer to the respective threshold values for that control parameter. If yes, i.e. if the measured values and respective threshold values corresponds to each other, the process returns to step 304 and the operating parameters are maintained at present values or levels. During the running of the process, a user can manually adapt the setting of the control parameters.

In FIG. 3*b*, an embodiment of the first and second control loops operating in synchronism is generally shown. At 310, the distance between the press rolls and the rotation speed of the press rolls are included as operating parameters. At 311, the vat pressure and linear load are included as control parameters. At 312 operator sets a threshold value, e.g. a maximum value for each of the control parameters. During operation of the apparatus, the specific control parameters are measured, at 313. At 314, measured values of control parameters and respective threshold value are compared to identify deviations. In practice, the measured value and the respective set threshold value is compared to identify whether the measured value is below or above the respective threshold value (taking into account any tolerance interval surrounding the threshold value). If no, i.e. if there is a deviation between the measured value and respective threshold value differs, one or several variable operating parameters of said set is/are adjusted according to first and second set of control rules, at 315, to bring or align the control parameter closer to the respective threshold values for that control parameter. If yes, i.e. if the measured values and respective threshold values corresponds to each other, the process returns to step 313 and the operating parameters are maintained at present values or levels. During the running of the process, a user can manually adapt the setting of the control parameters.

In FIG. 3*c*, a further embodiment of the first and second control loops operating in synchronism is generally shown. At 320, the distance between the press rolls and the rotation speed of the press rolls are included as operating parameters.

At 321, the vat pressure, linear load and torque are included as control parameters. At 322 operator sets a threshold value, e.g. a maximum value for each of the control parameters. During operation of the apparatus, the specific control parameters are measured, at 323. At 324, measured values of control parameters and respective threshold value are compared to identify deviations. In practice, the measured value and the respective set threshold value is compared to identify whether the measured value is below or above the respective threshold value (taking into account any tolerance interval surrounding the threshold value). If no, i.e. if there is a deviation between the measured value and respective threshold value differs, one or several variable operating parameters of said set is/are adjusted according to first and second set of control rules, at 325, to bring or align the control parameter closer to the respective threshold values for that control parameter. If yes, i.e. if the measured values and respective threshold values corresponds to each other, the process returns to step 323 and the operating parameters are maintained at present values or levels. During the running of the process, a user can manually adapt the setting of the control parameters.

Below, a number of exemplary control process rules (which however not are exhaustive) are described:

According to the first set of control rules, if a measured value of a control parameter is at a respective threshold value (i.e. the values corresponds to each other or a difference between the values is acceptable), at 406, the rotation speed of the press roll 102, 104 is maintained, at 407, at present level.

According to the first set of control rules, if a measured value of a control parameter is at respective threshold value for all control parameters (the values corresponds to each other or a difference between the respective values is acceptable), at 406, 503, the distance between the press rolls 102, 104 and the rotation speed of the press roll 102, 104 are maintained, at 407, 504, at present level.

According to the first and second set of control rules, If a measured value of vat pressure and linear load is at a respective threshold value (the values corresponds to each other or a difference is acceptable), at 406, 503, the distance between the press rolls 102, 104 and the rotation speed of the press roll 102, 104 are maintained, at 407, 504, at a present level.

According to the first set of control rules, if a measured value of a control parameter differs from a respective threshold value (the values deviates from each other or a difference is not acceptable) and the measured value exceeds the threshold value, at 404, the rotation speed of the press roll 102, 104 is increased, at 405, to reduce the difference.

According to the first set of control rules, if a measured value of a control parameter differs or deviates from a respective threshold value and the measured values are below the respective threshold values, at 408, the rotation speed of the press roll 102, 104 is reduced, at 409, to reduce the difference.

According to the second set of control rules, If a measured value of vat pressure or linear load differs or deviates from a respective threshold value, at 505, 506, 508, the distance between the press rolls 102, 104 is adjusted, at 507, 509, to reduce the difference.

According to the second set of control rules, if a measured value of linear load differs from the threshold value and the vat pressure is at the threshold value (the values corresponds to each other or a difference between measure value and threshold value is acceptable), at 508, the distance between the press rolls 102, 104 is decreased, at 509, to reduce the difference between the linear load and the threshold value.

Figure 4:
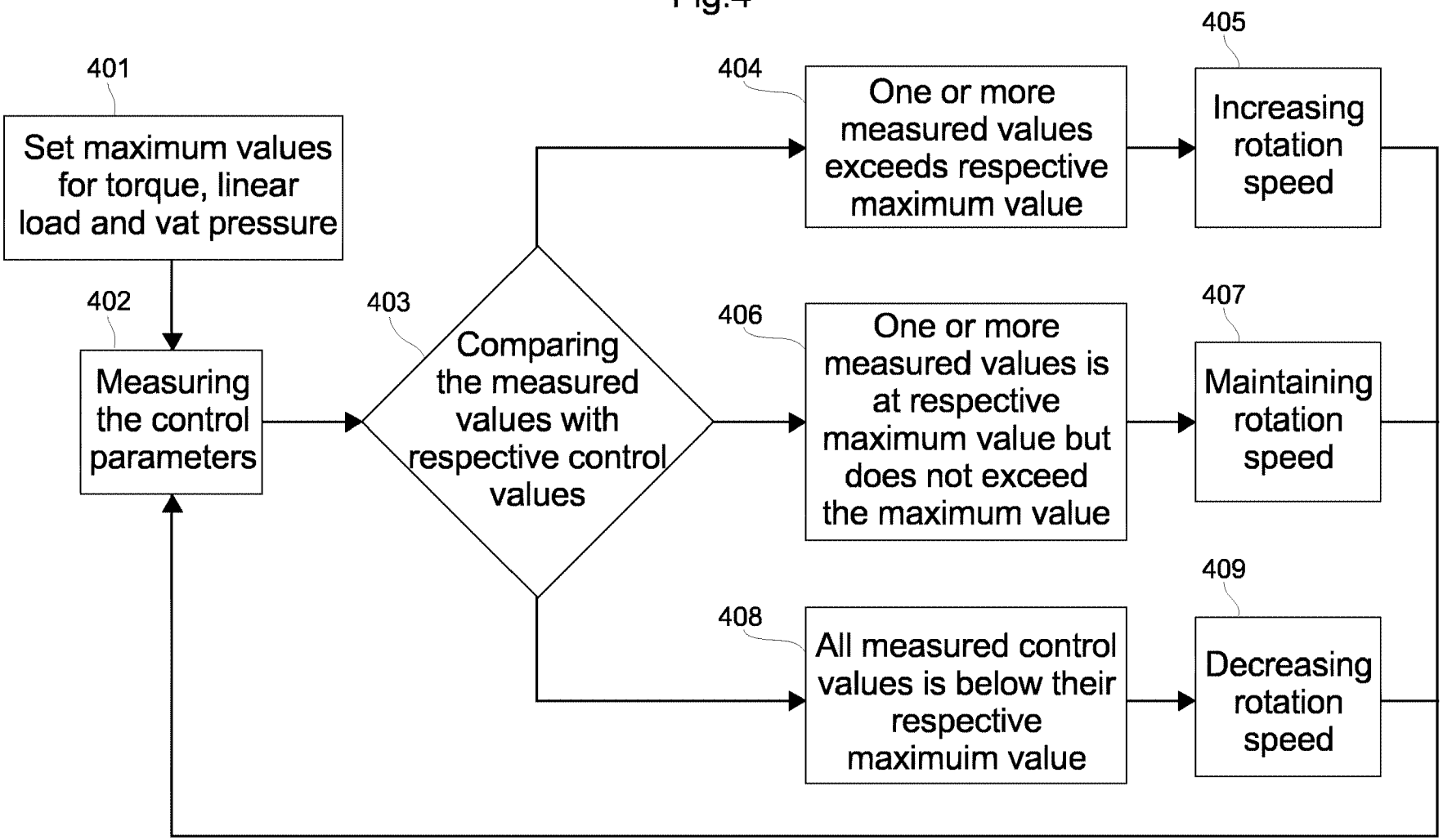
FIG. 4 is a schematic flow schedule illustrating further aspects of the method according to the present invention.
Figure 5:
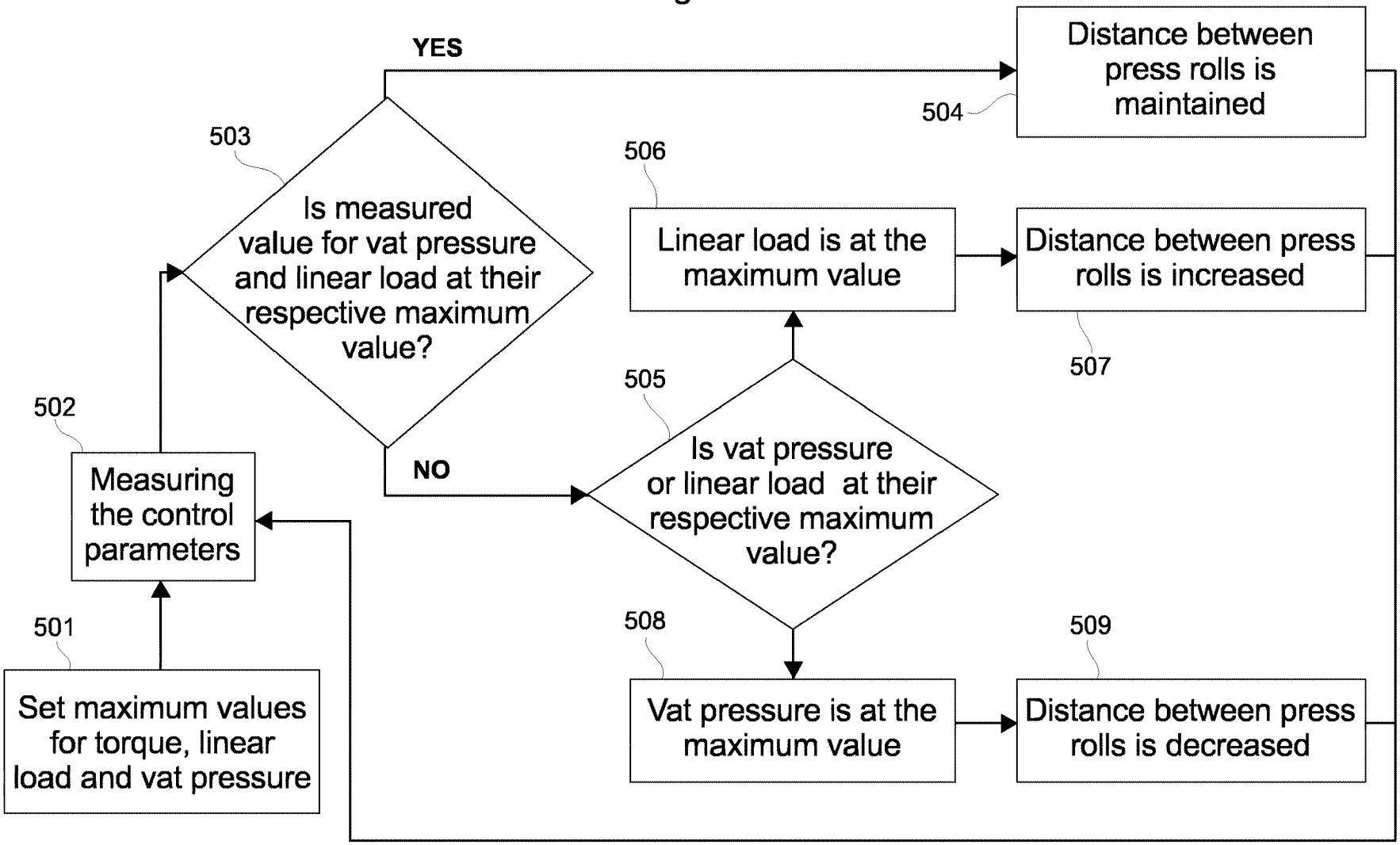
FIG. 5 is a schematic flow schedule illustrating further aspects of the method according to the present invention.
Figure 6:
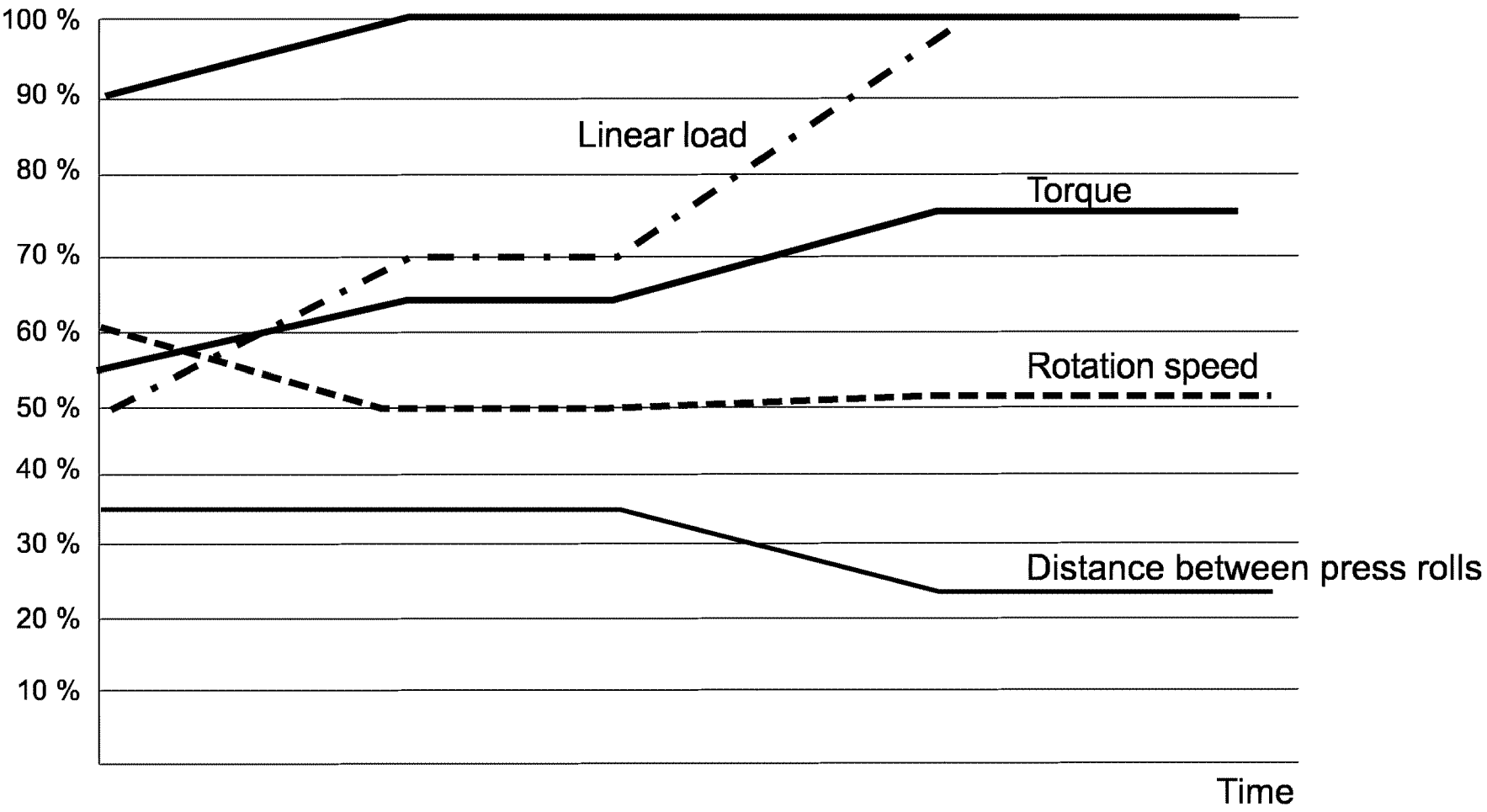
FIG. 6 is a simplified and schematic diagram shown an example of how control parameters may vary over time depending on adjustment of operating parameters under certain operating conditions.

According to the second set of control rules, if a measured value of vat pressure differs from the threshold value and the linear load is at the threshold value (the values deviates from each other or a difference between the measured value and threshold value is acceptable), at 506, the distance between the press rolls 102, 104 is increased, at 507, to reduce the difference between vat pressure and the threshold value With reference now to FIGS. 4-6, further embodiments of the present invention will be discussed.

In FIG. 4, the first control loop for controlling the rotation speed of the press rolls based on torque, linear load and vat pressure is shown. In embodiments of the present invention, the control loop for the rotation speed of the press rolls is based on at least one or a combination of any one of torque, linear load and vat pressure.

In FIG. 5, the second control loop for controlling the distance between the press rolls based on linear load and vat pressure is shown. According to the present invention, the control loops for the rotation speed of the press rolls and the distance between the press rolls are combined and thereby the washing efficiency, capacity and stability of operation of the apparatus can be optimized. However, it is possible to operate the two control loops independently of each other. For example, in certain embodiments, only the first control loop based on rotation speed is run. This embodiment is for example used in system where the press nip is not adjustable.

In FIG. 6, a simplified and schematic example operating scenario with the two control loops combined is illustrated.

Turning first to FIG. 4, the maximum values for the control parameters linear load, torque and vat pressure are set, at 401, and the current values for the respective control parameters are measured at 402. If one of the measured values exceeds the maximum value or a predetermined highest level in relation to the maximum value (for example, the measured value may be allowed to be within a range about the maximum value), at 403, the rotation speed will be increased at 404. At the same time, as shown in FIG. 5, the distance between the rolls will be adjusted only if it is the linear load or the vat pressure that deviates from the maximum value, see 505-509. In particular, if the linear load is at the maximum level or within the set tolerance and the vat pressure is not, at step 505 and 506, the distance between the press rolls is increased, at 507. On the other hand, if the vat pressure is at the maximum level or within the set tolerance and the linear load is not, at step 505 and 508, the distance between the press rolls is decreased, at 509.

Returning ow to FIG. 4, if one of the control parameters is at the maximum level, but not above, at step 406, the rotation speed of the press rolls is maintained at 407. At the same time, in the control loop for the distance between the rolls, the distance between the press rolls will be adjusted if the linear load or the vat pressure is not at their respective maximum value as shown at 505-509, as described above. If all threshold values are below their maximum values, the rotation speed of the press rolls will be reduced at 405. At the same time, the distance between the press rolls will be increased or decreased depending on whether the linear load deviates from its maximum value, at 506, 507, or the vat pressure deviates from its maximum value, at 508, 509.

This is also illustrated in FIG. 6, a simplified and schematic example where values of the control parameters, vat pressure, torque and linear load, are shown and how adjustments of the operating parameters, distance between the press rolls and the rotation speed of the press rolls, affects the control parameters over time.

Even though the present invention has been described above using exemplifying embodiments thereof, alterations, modifications, and combinations thereof, as understood by those skilled in the art, may be made without departing from the scope of the invention as defined in the accompanying claims.

The invention claimed is:

1. A method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in a direction of rotation of the press rolls through the press nip, and the processing of the pulp in the apparatus is determined by at least one variable operating parameter which is variable during operation, wherein at least one of the press rolls is movable in relation to the other press roll to vary the press nip, the method comprising:

providing a controller programmed to:

cause the apparatus to process the pulp while varying a variable operating parameter, the variable operating parameter comprising:

a rotation speed of at least one of the press rolls, or a distance between the press rolls, measure a control parameter, the control parameter comprising at least one of:

a vat pressure of the vat, the vat pressure associated with a first predetermined threshold value, or a linear load which acts on the pulp in the press nip, the linear load associated with a second predetermined threshold value, compare at least one of:

the vat pressure to the first predetermined threshold value, or the linear load to the second predetermined threshold value, when at least one of: (i) the vat pressure deviates from the first predetermined threshold value or (ii) the linear load deviates from the second predetermined threshold value, adjust the rotation speed and the distance, when: (i) the vat pressure corresponds to the first predetermined threshold value and the linear load is below the second predetermined threshold value, or (ii) the linear load corresponds to the second predetermined threshold value and the vat pressure is below the first predetermined threshold value, maintain the rotation speed at a present level; and using the controller to:

cause the apparatus to process the pulp while varying the variable operating parameter, measure the control parameter, compare at least one of:

the vat pressure to the first predetermined threshold value, or the linear load to the second predetermined threshold value, and when at least one of: (i) the vat pressure deviates from the first predetermined threshold value or (ii) the linear load deviates from the second predetermined threshold value, adjust the rotation speed and the distance, and when: (i) the vat pressure corresponds to the first predetermined threshold value and the linear load is below the second predetermined threshold value, or (ii) the linear load corresponds to the second predetermined threshold value and the vat pressure is below the first predetermined threshold value, maintain the rotation speed at the present level.

2. The method of claim 1, wherein:

the control parameter further comprises a torque associated with a third predetermined threshold value; and the controller is further programmed to:

compare the torque to the third predetermined threshold value;

when at least one of: (i) the vat pressure deviates from the first predetermined threshold value or (ii) the linear load deviates from the second predetermined threshold value, adjust the rotation speed and the distance when the torque deviates from the third predetermined threshold value; and the controller is further used to:

compare the torque to the third predetermined threshold value; and when at least one of: (i) the vat pressure deviates from the first predetermined threshold value or (ii) the linear load deviates from the second predetermined threshold value, adjust the rotation speed and the distance when the torque deviates from the third predetermined threshold value.

3. The method of claim 1, wherein the control parameter further comprises a torque of the press rolls associated with a third predetermined threshold value.

4. The method of claim 1, wherein:

the controller is further programmed to:

set the first predetermined threshold value to a target maximum vat pressure before comparing the vat pressure to the first predetermined threshold value, and set the second predetermined threshold value to a target maximum linear load before comparing the linear load to the second predetermined threshold value; and the controller is further used to:

set the first predetermined threshold value to the target maximum vat pressure before comparing the vat pressure to the first predetermined threshold value, and set the second predetermined threshold value to the target maximum linear load before comparing the linear load to the second predetermined threshold value.

5. The method of claim 1, wherein:

the controller is further programmed to, when at least one of: (i) the vat pressure is greater than the first predetermined threshold value, or (ii) the linear load is greater than the second predetermined threshold value, increase the rotation speed; and the controller is further used to, when at least one of: (i) the vat pressure is greater than the first predetermined threshold value, or (ii) the linear load is greater than the second predetermined threshold value, increase the rotation speed.

6. The method of claim 1, wherein:

the controller is further programmed to, when at least one of: (i) the vat pressure is less than the first predetermined threshold value, or (ii) the linear load is less than the second predetermined threshold value, decrease the rotation speed; and the controller is further used to, when at least one of: (i) the vat pressure is less than the first predetermined threshold value, or (ii) the linear load is less than the second predetermined threshold value, decrease the rotation speed.

7. The method of claim 1, wherein:

the controller is further programmed to, when: (i) the linear load deviates from the second predetermined threshold value, and (ii) the vat pressure corresponds to the first predetermined threshold value, decrease the distance; and the controller is further used to, when: (i) the linear load deviates from the second predetermined threshold value, and (ii) the vat pressure corresponds to the first predetermined threshold value, decrease the distance.

8. The method of claim 7, wherein:

the controller is further programmed to, when: (i) the linear load is less than the second predetermined threshold value, and (ii) the vat pressure corresponds to the first predetermined threshold value, decrease the distance; and the controller is further used to, when: (i) the linear load is less than the second predetermined threshold value, and (ii) the vat pressure corresponds to the first predetermined threshold value, decrease the distance.

9. The method of claim 1, wherein:

the controller is further programmed to, when: (i) the vat pressure deviates from the first predetermined threshold value, and (ii) the linear load corresponds to the second predetermined threshold value, increase the distance; and the controller is further used to, when: (i) the vat pressure deviates from the first predetermined threshold value, and (ii) the linear load corresponds to the second predetermined threshold value, increase the distance.

10. The method of claim 9, wherein:

the controller is further programmed to, when: (i) the vat pressure is less than the first predetermined threshold value, and (ii) the linear load corresponds to the second predetermined threshold value, increase the distance; and the controller is further used to, when: (i) the vat pressure is less than the first predetermined threshold value, and (ii) the linear load corresponds to the second predetermined threshold value, increase the distance.

11. The method of claim 1, wherein the control parameter further comprises at least one of:

a pressure of the apparatus, or a throttle gap width associated with an opening gap of a throttle arranged close to or in an outlet of the apparatus.

12. A method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in a direction of rotation of the press rolls through the press nip, and the processing of the pulp in the apparatus is determined by at least one variable operating parameter which is variable during operation, wherein at least one of the press rolls is movable in relation to the other press roll to vary the press nip, the method comprising:

providing a controller programmed to:

cause the apparatus to process the pulp while varying a variable operating parameter, the variable operating parameter comprising:

a rotation speed of at least one of the press rolls, or a distance between the press rolls, measure a control parameter, the control parameter comprising:

a torque associated with a first predetermined threshold value, a vat pressure of the vat, the vat pressure associated with a second predetermined threshold value, and a linear load which acts on the pulp in the press nip, the linear load associated with a third predetermined threshold value, compare the torque to the first predetermined threshold value, and when the torque deviates from the first predetermined threshold value, adjust the rotation speed and the distance, compare the vat pressure to the second predetermined threshold value, compare the linear load to the third predetermined threshold value, and when: (i) the vat pressure corresponds to the second predetermined threshold value and the linear load is below the third predetermined threshold value, and (ii) the linear load corresponds to the third predetermined threshold value and the vat pressure is below the second predetermined threshold value, maintain the rotation speed at a present level; and using the controller to:

cause the apparatus to process the pulp while varying the variable operating parameter, measure the control parameter, compare the torque to the first predetermined threshold value, when the torque deviates from the first predetermined threshold value, adjust the rotation speed and the distance, compare the vat pressure to the second predetermined threshold value, compare the linear load to the third predetermined threshold value, and when: (i) the vat pressure corresponds to the second predetermined threshold value and the linear load is below the third predetermined threshold value, or (ii) the linear load corresponds to the third predetermined threshold value and the vat pressure is below the second predetermined threshold value, maintain the rotation speed at the present level.

13. The method of claim 12, wherein:

the controller is further programmed to:

set the second predetermined threshold value to a target maximum vat pressure before comparing the vat pressure to the second predetermined threshold value, and set the third predetermined threshold value to a target maximum linear load before comparing the linear load to the third predetermined threshold value; and the controller is further used to:

set the second predetermined threshold value to the target maximum vat pressure before comparing the vat pressure to the second predetermined threshold value, and set the third predetermined threshold value to the target maximum linear load before comparing the linear load to the third predetermined threshold value.

14. The method of claim 12, wherein:
the controller is further programmed to
when at least one of: (i) the vat pressure is greater than the second predetermined threshold value, or (ii) the linear load is greater than the third predetermined threshold value, increase the rotation speed; and
the controller is further used to
when at least one of: (i) the vat pressure is greater than the second predetermined threshold value, or (ii) the linear load is greater than the third predetermined threshold value, increase the rotation speed.

15. The method of claim 12, wherein:
the controller is further programmed to
when at least one of: (i) the vat pressure is less than the second predetermined threshold value, or (ii) the linear load is less than the third predetermined threshold value, decrease the rotation speed; and
the controller is further used to
when at least one of: (i) the vat pressure is less than the second predetermined threshold value, or (ii) the linear load is less than the third predetermined threshold value, decrease the rotation speed.

16. The method of claim 12, wherein:
the controller is further programmed to
when at least one of: (i) the vat pressure corresponds to the second predetermined threshold value, or (ii) the linear load corresponds to the third predetermined threshold value, maintain the distance at a present level;
the controller is further used to:
when at least one of: (i) the vat pressure corresponds to the second predetermined threshold value, or (ii) the linear load corresponds to the third predetermined threshold value, maintain the distance at the present level.

17. The method of claim 12, wherein:
the controller is further programmed to
when: (i) the linear load deviates from the third predetermined threshold value, and (ii) the vat pressure corresponds to the second predetermined threshold value, decrease the distance; and
the controller is further used to
when: (i) the linear load deviates from the third predetermined threshold value, and (ii) the vat pressure corresponds to the second predetermined threshold value, decrease the distance.

18. The method of claim 17, wherein:
the controller is further programmed to, when: (i) the linear load is less than the third predetermined threshold value, and (ii) the vat pressure corresponds to the second predetermined threshold value, decrease the distance; and
the controller is further used to, when: (i) the linear load is less than the third predetermined threshold value, and (ii) the vat pressure corresponds to the second predetermined threshold value, decrease the distance.

19. The method of claim 12, wherein:
the controller is further programmed to:
when: (i) the vat pressure deviates from the second predetermined threshold value, and (ii) the linear load corresponds to the third predetermined threshold value, increase the distance; and
the controller is further used to
when: (i) the vat pressure deviates from the second predetermined threshold value, and (ii) the linear load corresponds to the third predetermined threshold value, increase the distance.

20. The method of claim 19, wherein:
the controller is further programmed to, when: (i) the vat pressure is less than the second predetermined threshold value, and (ii) the linear load corresponds to the third predetermined threshold value, increase the distance; and
the controller is further used to, when: (i) the vat pressure is less than the second predetermined threshold value, and (ii) the linear load corresponds to the third predetermined threshold value, increase the distance.

21. The method of claim 12, wherein the control parameter further comprises at least one of:
a pressure of the apparatus, or
a throttle gap width associated with an opening gap of a throttle arranged close to or in an outlet of the apparatus.

22. A method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in a direction of rotation of the press rolls through the press nip, and the processing of the pulp in the apparatus is determined by at least one variable operating parameter which is variable during operation, wherein at least one of the press rolls is movable in relation to the other press roll to vary the press nip, the method comprising:
providing a controller programmed to:
cause the apparatus to process the pulp while varying a variable operating parameter, the variable operating parameter comprising:
a rotation speed of at least one of the press rolls, or
a distance between the press rolls,
measure a control parameter, the control parameter comprising at least one of:
a vat pressure of the vat, the vat pressure associated with a first predetermined threshold value, or
a linear load which acts on the pulp in the press nip, the linear load associated with a second predetermined threshold value,
compare at least one of:
the vat pressure to the first predetermined threshold value, or
the linear load to the second predetermined threshold value,
when at least one of: (i) the vat pressure deviates from the first predetermined threshold value or (ii) the linear load deviates from the second predetermined threshold value, adjust the rotation speed and the distance,
when: (i) the linear load deviates from the second predetermined threshold value, and (ii) the vat pressure corresponds to the first predetermined threshold value, decrease the distance; and
using the controller to:
cause the apparatus to process the pulp while varying the variable operating parameter,
measure the control parameter,
compare at least one of:
the vat pressure to the first predetermined threshold value, or
the linear load to the second predetermined threshold value,
when at least one of: (i) the vat pressure deviates from the first predetermined threshold value or (ii) the linear load deviates from the second predetermined threshold value, adjust the rotation speed and the distance, and when: (i) the linear load deviates from the second predetermined threshold value, and (ii) the vat pressure corresponds to the first predetermined threshold value, decrease the distance.

23. The method of claim 22, wherein:

the controller is further programmed to, when: (i) the linear load is less than the second predetermined threshold value, and (ii) the vat pressure corresponds to the first predetermined threshold value, decrease the distance; and the controller is further used to, when: (i) the linear load is less than the second predetermined threshold value, and (ii) the vat pressure corresponds to the first predetermined threshold value, decrease the distance.

24. A method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in a direction of rotation of the press rolls through the press nip, and the processing of the pulp in the apparatus is determined by at least one variable operating parameter which is variable during operation, wherein at least one of the press rolls is movable in relation to the other press roll to vary the press nip, the method comprising:

providing a controller programmed to:

cause the apparatus to process the pulp while varying a variable operating parameter, the variable operating parameter comprising:

a rotation speed of at least one of the press rolls, or a distance between the press rolls, measure a control parameter, the control parameter comprising at least one of:

a vat pressure of the vat, the vat pressure associated with a first predetermined threshold value, or a linear load which acts on the pulp in the press nip, the linear load associated with a second predetermined threshold value, compare at least one of:

the vat pressure to the first predetermined threshold value, or the linear load to the second predetermined threshold value, when at least one of: (i) the vat pressure deviates from the first predetermined threshold value or (ii) the linear load deviates from the second predetermined threshold value, adjust the rotation speed and the distance, and when: (i) the vat pressure deviates from the first predetermined threshold value, and (ii) the linear load corresponds to the second predetermined threshold value, increase the distance; and using the controller to:

cause the apparatus to process the pulp while varying the variable operating parameter, measure the control parameter, compare at least one of:

the vat pressure to the first predetermined threshold value, or the linear load to the second predetermined threshold value, when at least one of: (i) the vat pressure deviates from the first predetermined threshold value or (ii) the linear load deviates from the second predetermined threshold value, adjust the rotation speed and the distance, and when: (i) the vat pressure deviates from the first predetermined threshold value, and (ii) the linear load corresponds to the second predetermined threshold value, increase the distance.

25. The method of claim 24, wherein:

the controller is further programmed to, when: (i) the vat pressure is less than the first predetermined threshold value, and (ii) the linear load corresponds to the second predetermined threshold value, increase the distance; and the controller is further used to, when: (i) the vat pressure is less than the first predetermined threshold value, and (ii) the linear load corresponds to the second predetermined threshold value, increase the distance.

26. A method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in a direction of rotation of the press rolls through the press nip, and the processing of the pulp in the apparatus is determined by at least one variable operating parameter which is variable during operation, wherein at least one of the press rolls is movable in relation to the other press roll to vary the press nip, the method comprising:

providing a controller programmed to:

cause the apparatus to process the pulp while varying a variable operating parameter, the variable operating parameter comprising:

a rotation speed of at least one of the press rolls, or a distance between the press rolls, measure a control parameter, the control parameter comprising:

a torque associated with a first predetermined threshold value, a vat pressure of the vat, the vat pressure associated with a second predetermined threshold value, and a linear load which acts on the pulp in the press nip, the linear load associated with a third predetermined threshold value, compare the torque to the first predetermined threshold value, when the torque deviates from the first predetermined threshold value, adjust the rotation speed and the distance, compare the vat pressure to the second predetermined threshold value, compare the linear load to the third predetermined threshold value, and when: (i) the linear load deviates from the third predetermined threshold value, and (ii) the vat pressure corresponds to the second predetermined threshold value, decrease the distance; and using the controller to:

cause the apparatus to process the pulp while varying the variable operating parameter, measure the control parameter, compare the torque to the first predetermined threshold value, and when the torque deviates from the first predetermined threshold value, adjust the rotation speed and the distance, compare the vat pressure to the second predetermined threshold value, compare the linear load to the third predetermined threshold value, and when: (i) the linear load deviates from the third predetermined threshold value, and (ii) the vat pressure corresponds to the second predetermined threshold value, decrease the distance.

27. The method of claim 26, wherein:

the controller is further programmed to, when: (i) the linear load is less than the third predetermined threshold value, and (ii) the vat pressure corresponds to the second predetermined threshold value, decrease the distance; and the controller is further used to, when: (i) the linear load is less than the third predetermined threshold value, and (ii) the vat pressure corresponds to the second predetermined threshold value, decrease the distance.

28. A method for processing pulp in an apparatus for washing and dewatering pulp comprising two rotatable press rolls having a permeable outer surface, and a vat in which the press rolls are installed, the press rolls defining a press nip between them, in which press nip the pulp is pressed, and the apparatus is arranged to feed the pulp in a direction of rotation of the press rolls through the press nip, and the processing of the pulp in the apparatus is determined by at least one variable operating parameter which is variable during operation, wherein at least one of the press rolls is movable in relation to the other press roll to vary the press nip, the method comprising:

providing a controller programmed to:

cause the apparatus to process the pulp while varying a variable operating parameter, the variable operating parameter comprising:

a rotation speed of at least one of the press rolls, or a distance between the press rolls;

measure a control parameter, the control parameter comprising:

a torque associated with a first predetermined threshold value, a vat pressure of the vat, the vat pressure associated with a second predetermined threshold value, and a linear load which acts on the pulp in the press nip, the linear load associated with a third predetermined threshold value, compare the torque to the first predetermined threshold value, when the torque deviates from the first predetermined threshold value, adjust the rotation speed and the distance, compare the vat pressure to the second predetermined threshold value, compare the linear load to the third predetermined threshold value, and when: (i) the vat pressure deviates from the second predetermined threshold value, and (ii) the linear load corresponds to the third predetermined threshold value, increase the distance; and using the controller to:

cause the apparatus to process the pulp while varying the variable operating parameter, measure the control parameter, compare the torque to the first predetermined threshold value, and when the torque deviates from the first predetermined threshold value, adjust the rotation speed and the distance, compare the vat pressure to the second predetermined threshold value, compare the linear load to the third predetermined threshold value, and when: (i) the vat pressure deviates from the second predetermined threshold value, and (ii) the linear load corresponds to the third predetermined threshold value, increase the distance.

29. The method of claim 28, wherein:

the controller is further programmed to, when: (i) the vat pressure is less than the second predetermined threshold value, and (ii) the linear load corresponds to the third predetermined threshold value, increase the distance; and the controller is further used to, when: (i) the vat pressure is less than the second predetermined threshold value, and (ii) the linear load corresponds to the third predetermined threshold value, increase the distance.

* * * * *